US007971989B2

(12) United States Patent
Sasaki

(10) Patent No.: US 7,971,989 B2
(45) Date of Patent: Jul. 5, 2011

(54) PRINTER USED WITH ROLLED SHEET

(75) Inventor: Toshiyuki Sasaki, Yamagata-mura (JP)

(73) Assignee: Seiko Epson Corporation, Tokyo (JP)

( * ) Notice: Subject to any disclaimer, the term of this patent is extended or adjusted under 35 U.S.C. 154(b) by 998 days.

(21) Appl. No.: 11/633,438

(22) Filed: Dec. 5, 2006

(65) Prior Publication Data

US 2007/0126790 A1 Jun. 7, 2007

(30) Foreign Application Priority Data

Dec. 7, 2005 (JP) ..... P2005-353040
Dec. 7, 2005 (JP) ..... P2005-353041

(51) Int. Cl.
*B41J 2/15* (2006.01)

(52) U.S. Cl. ..... 347/104; 101/235; 347/40; 347/41; 347/85; 347/86; 347/105; 400/188; 400/283

(58) Field of Classification Search ..... None
See application file for complete search history.

(56) References Cited

U.S. PATENT DOCUMENTS

| | | | | |
|---|---|---|---|---|
| 4,523,523 | A * | 6/1985 | Abellana et al. | 101/235 |
| 4,853,708 | A * | 8/1989 | Walters | 347/86 |
| 5,805,183 | A * | 9/1998 | Lidke et al. | 347/41 |
| 6,092,949 | A * | 7/2000 | Koyabu et al. | 400/642 |
| 6,367,906 | B1 | 4/2002 | Hiramatsu et al. | |
| 6,474,883 | B1 | 11/2002 | Kawakami et al. | |
| 7,645,037 | B2 * | 1/2010 | Massey | 347/105 |
| 7,712,891 | B2 | 5/2010 | Ishida et al. | |
| 2002/0024553 | A1 * | 2/2002 | Nishioka et al. | 347/37 |
| 2002/0080621 | A1 * | 6/2002 | Ogura | 362/551 |
| 2002/0163568 | A1 * | 11/2002 | Takeishi | 347/101 |
| 2003/0012591 | A1 * | 1/2003 | Maruyama et al. | 400/283 |
| 2004/0028447 | A1 * | 2/2004 | Sasaki | 400/578 |
| 2005/0174397 | A1 * | 8/2005 | Scardovi et al. | 347/85 |
| 2008/0030530 | A1 | 2/2008 | Ishida et al. | |

FOREIGN PATENT DOCUMENTS

| | | |
|---|---|---|
| JP | 9-99564 | 4/1997 |
| JP | 11-138781 | 5/1999 |
| JP | 11-198444 | 7/1999 |
| JP | 2001-138548 | 5/2001 |
| JP | 2001-158141 | 6/2001 |
| JP | 2001-270191 | 10/2001 |
| JP | 2002-273861 | 9/2002 |
| JP | 2002-347261 | 12/2002 |

(Continued)

*Primary Examiner* — Matthew Luu
*Assistant Examiner* — Kendrick X Liu
(74) *Attorney, Agent, or Firm* — Nixon & Vanderhye P.C.

(57) ABSTRACT

In a printer, a first section is sized to accommodate a rolled sheet therein. A printing head is horizontally movable along a moving path extending in a first direction and operable to perform printing on a part of the rolled sheet which is drawn out from the first section. A second section is provided on a first side of the first section relative to the first direction. A third section is provided on a second side of the first section relative to the first direction opposite to the first side. A control board on which a circuit operable to control an operation of the printer is mounted is disposed in the first section so as to extend vertically. An ink supplying member is disposed in the third section that supplies ink to the printing head. The moving path is longer than a dimension of the first section in the first direction.

13 Claims, 6 Drawing Sheets

FOREIGN PATENT DOCUMENTS

| | | |
|---|---|---|
| JP | 2003-266731 | 9/2003 |
| JP | 2004-174749 | 6/2004 |
| JP | 2005-52992 | 3/2005 |
| JP | 2005-088235 | 4/2005 |
| JP | 2005-186590 | 7/2005 |

* cited by examiner

PRINTER USED WITH ROLLED SHEET

BACKGROUND

1. Technical Field

The present invention relates to a serial-type printer used with a rolled sheet in which printing is performed on a rolled sheet while a printing head is moved in a width direction of the printer, and more particularly, to an improved technique for downsizing the printer.

2. Related Art

A serial type printer using a rolled sheet is known for issuing a receipt or the like, wherein the performs printing while a printing head mounted on a carriage is moved in a lateral direction of the rolled sheet. Generally, in the printer of this type, the rolled sheet is accommodated so as to extend in the lateral direction horizontally, and printing is performed on an elongated sheet drawn out from the rolled sheet while reciprocally moving the carriage mounting the printing head in the lateral direction.

In this structure, a moving range of the carriage which carries the printing head, that is, the moving range of the carriage required for performing one line of printing is larger in the lateral direction, as compared with a dimension of the rolled sheet in the lateral direction. Therefore, it is necessary to provide a space having a laterally larger width than a rolled sheet chamber, as a moving space for the carriage. For this reason, a dimension of the printer in the lateral direction depends on the moving space of the carriage, and a dead space is formed at one or both sides of the rolled sheet chamber in the lateral direction of the printer. This dead space is an obstacle when the serial-type printer is intended to be downsized.

In the serial-type printer in which an ink jet head is employed as the printing head, a DC motor is sometimes used as a motor for moving the carriage on which the ink jet head is mounted. In this case, a linear scale is provided along a moving path of the carriage for the purpose of detecting a rotation direction and a rotation position of the DC motor, that is, a moving position of the carriage. For example, in case of an optical linear scale, the linear scale is provided with a plurality of slits, and a photo sensor mounted on the carriage reads the slits, whereby an A-phase signal and a B-phase signal which are shifted, for example, by 90 degrees are generated. According to such detection signals, rotary conditions such as the rotating direction and the rotation speed of the DC motor (the moving direction and the moving speed of the carriage) are detected. The DC motor is feedback controlled according to the results of the detection, so that the movement of the ink jet head which is mounted on the carriage can be controlled.

On this occasion, a part of an ink drop which is ejected from the ink jet head to the recording sheet floats as minute ink mist. Moreover, a nozzle face of the ink jet head is opposed to the recording sheet keeping a narrow gap. Consequently, when the carriage which carries the ink jet head reciprocally moves, a negative pressure is created in the gap, and a part of the ink drop is blown off to generate the ink mist. The generated ink mist flies on an air stream which is created with the movement of the carriage and is scattered around, so that surfaces of components around the carriage may be soiled. Particularly, where the air stream created with the movement of the carriage flows in a direction perpendicular to the moving direction of the carriage, there is a concern that a surface of the linear scale which is arranged near the carriage along the moving path of the carriage may be soiled with the ink mist, which will hinder normal position detecting operation.

In order to avoid this concern, in Japanese Patent Publication No. 11-138781A (JP-A-11-138781), a blowing fan is arranged near the moving path of the carriage to create an air stream flowing in the moving direction of the carriage so that the ink mist may not run toward the linear scale. In Japanese Patent Publication No. 2001-138548A (JP-A-2001-138548), wind guide plates are arranged so as to create an air stream by a moving force of a printing head, and the ink mist is ejected by the air stream. In Japanese Patent Publication No. 2005-88235A (JP-A-2005-88235), a regulating rib is provided on a surface of the carriage to regulate an air stream created with the movement of the carriage so that the air stream will not run toward the linear scale behind the carriage.

In the small-size rolled sheet printer which issues a receipt or the like, there is only a small space for moving the ink jet head. Accordingly, it is impossible, in many cases, to secure a space for installing the blowing fan which will create the air stream, a space for installing the wind guide plates, or a space for moving the carriage having the regulating rib formed on the surface. Therefore, incorporation of a mechanism for preventing deposition of the ink mist on the linear scale has been a problem, particularly when the rolled sheet printer of the serial type is intended to be downsized.

SUMMARY

It is therefore one advantageous aspect of the invention to provide a printer used with a rolled sheet which is downsized by effectively utilizing a dead space formed at least at a side of a rolled sheet chamber to arrange components for the printer.

It is also one advantageous aspect of the invention to provide a printer used with a rolled sheet in which a mechanism for preventing a linear scale from being soiled with ink mist can be incorporated in a narrow space, whereby the printer for the rolled sheet can be downsized.

According to one aspect of the invention, there is provided a printer, comprising:

a first section sized to accommodate a rolled sheet therein;

a printing head horizontally movable along a moving path extending in a first direction and operable to perform printing on a part of the rolled sheet which is drawn out from the first section;

a second section on a first side of the first section relative to the first direction;

a third section on a second side of the first section relative to the first direction opposite to the first side;

a control board on which a circuit operable to control an operation of the printer is mounted disposed in the first section so as to extend vertically; and an ink supplying member disposed in the third section that supplies ink to the printing head, wherein the moving path is longer than a dimension of the first section in the first direction.

Since the moving pass of the printing head is longer in the first direction than a width of the first section in the first direction, spaces are formed at both sides of the first chamber. With the above configuration, such spaces are utilized to dispose the control board and the ink supplying member therein. Consequently, there is no necessity of separately providing the places for installing the control board and the ink supplying member. For example, as compared with the case where the control board is horizontally arranged in the bottom part of the printer, the height of the printer can be reduced. Accordingly, a compact rolled sheet printer can be realized.

Moreover, since the control board is arranged vertically, liquid such as ink and water from a leak or the like will rapidly fall along the surface of the board. When the control board is arranged horizontally, a short circuit or the like may occur due to standing liquid on the board surface. With the above configuration, however, a risk of incurring such trouble can be reduced.

The printing head may be an ink jet head.

The printer may further comprise a head maintenance unit that performs a maintenance operation for the printing head, the head maintenance unit disposed on the moving path on the second side of the first section.

In case where the ink jet head is used as the printing head, the head maintenance unit is provided for the purpose of protecting a nozzle face of the printing head while it is not used, and preventing the nozzle from clogging due to the solidification of the ink staying in the nozzle. With the above configuration, it is possible to effectively utilize a dead space at the side of the first section which is formed for securing the moving space of the printing head. This is advantageous in downsizing the rolled sheet printer.

The head maintenance unit may be disposed above the third section.

The printer may further comprise a head unit disposed above the first section, the control board and the head maintenance unit. The head unit comprises a unit frame including a main frame extending in the first direction and side frames provided on both ends of the main frame relative to the first direction; a guide shaft, extending in the first direction and bridging the side frames; and a carriage mounting the printing head and movable along the guide shaft to carry the printing head along the moving path.

The first section may be arranged such that an axial direction of the rolled sheet matches with the first direction.

The first section may be formed with an opening arranged such that the rolled sheet is replaced therethrough. The opening may be located in a front side of the printer.

The ink supplying member may be an ink cartridge.

The second section may be formed with an opening arranged such that the ink cartridge is replaced therethrough.

The printer may further comprise: a linear scale, extending in the first direction and provided with slit patterns adapted to be detected to determine a position of the printing head in the first direction; and a plate member, extending in the first direction and disposed between the moving path and the linear scale, the plate member being sized and positioned to block an air stream flowing from the printing head to the linear scale.

With the above configuration, the air stream flowing from the printing head to a side of the linear scale can be reliably blocked across the moving path. Accordingly, it is possible to prevent a surface of the linear scale from being soiled due to adhesion of ink mist to the surface.

Further, since the plate member is arranged along the moving path of the ink jet head, the components around the ink jet head, the guide shaft, the linear scale, and so on are arranged in parallel with the moving path. As a result, a dead space is formed between these components along the direction of the moving path. Since such dead space can be utilized to dispose the plate member therein, it is possible to dispose the plate member without incurring upsizing. Therefore, the invention can be suitably applied to a downsized printer which has restrictions in respect of the space for installing components.

The printer may further comprise: a first plate member disposed adjacent a first end of the moving path; and a second plate member disposed in a second end of the moving path opposite to the first end. At least one of the first plate member and the second plate member is formed with a through hole.

By securing passage of air between the moving space of the ink jet head and the exterior through the through hole, the flow of ambient air created by the movement of the ink jet head can be smoothed. Moreover, a negative pressure generated between the nozzle face of the ink jet head and the sheet opposed to each other with a narrow gap is moderated. As a result, an amount of ink mist can be reduced.

The printer may further comprise: a guide shaft extending in the first direction and bridging the first plate member and the second plate member; and a carriage, mounting the printing head and movable along the guide shaft to carry the printing head along the moving path. The through hole may oppose the carriage.

The printer may further comprise a head unit disposed above the first section, the control board and the head maintenance unit. The printing head, the carriage, the guide shaft, the linear scale and the plate member may be integrated in the head unit.

According to another aspect of the invention, there is also provided a compact rolled sheet printer comprising:

a printing head horizontally movable along a moving path extending in a first direction;

a printer casing defining the moving path and supporting the printing head, the printer casing including a first section sized to accommodate a rolled sheet therein, a second section on one side of the first section relative to the first direction, and a third section on an opposite side of the first section relative to the first direction, wherein:

the printing head is operable to perform printing on a part of the rolled sheet which is drawn out from the first section; and components of the printer necessary to effect printing are provided in the second section and the third section.

BRIEF DESCRIPTION OF THE DRAWINGS

These and other aspects and advantages of the present invention will be described in detail with reference to the accompanying drawings, in which.

DETAILED DESCRIPTION OF EXEMPLARY EMBODIMENTS

Embodiments of the invention will be described below in detail with reference to the accompanying drawings.

Figure 1:
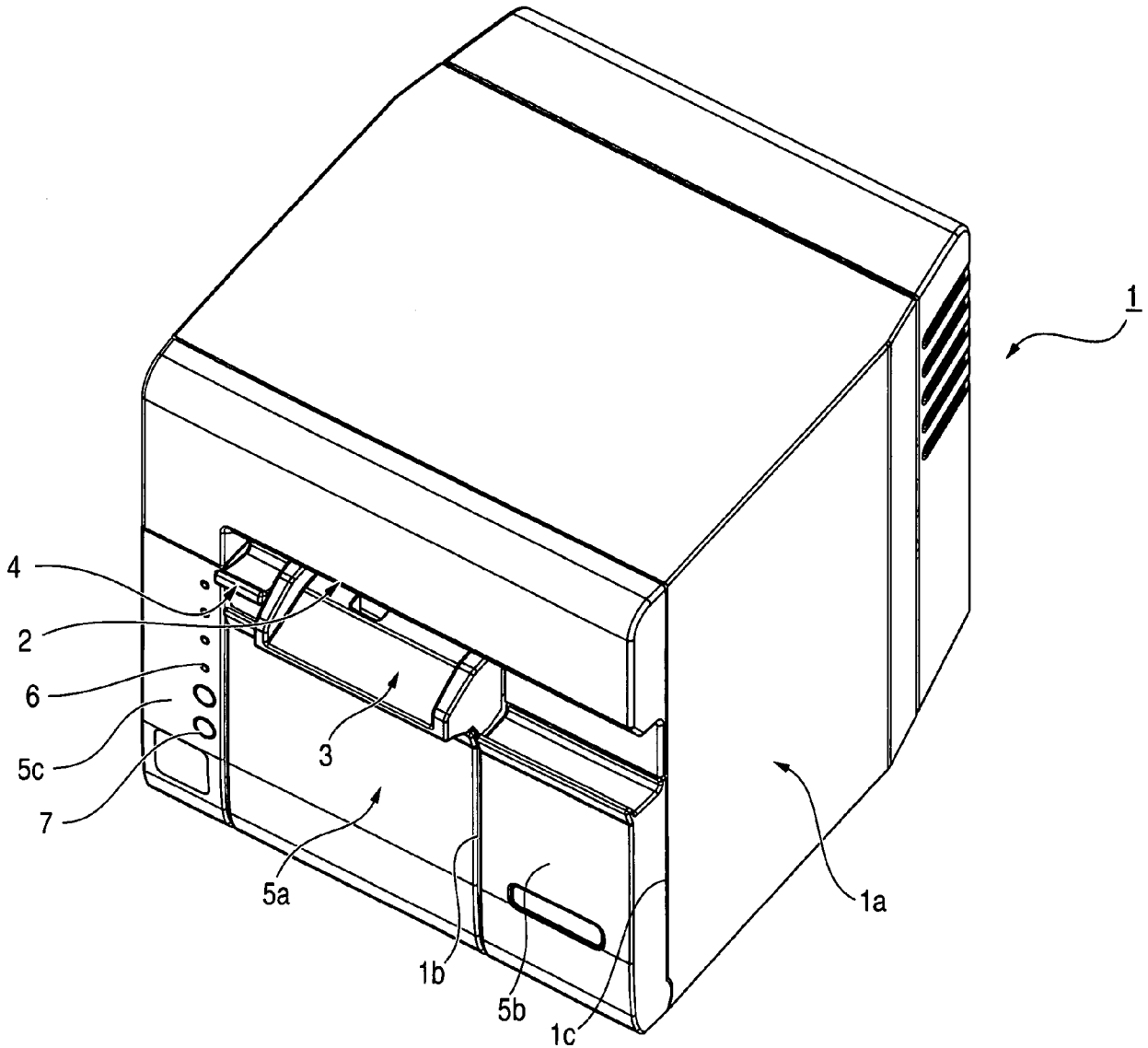
FIG. 1 is a perspective view of a printer according to one embodiment of the invention.
Figure 2:
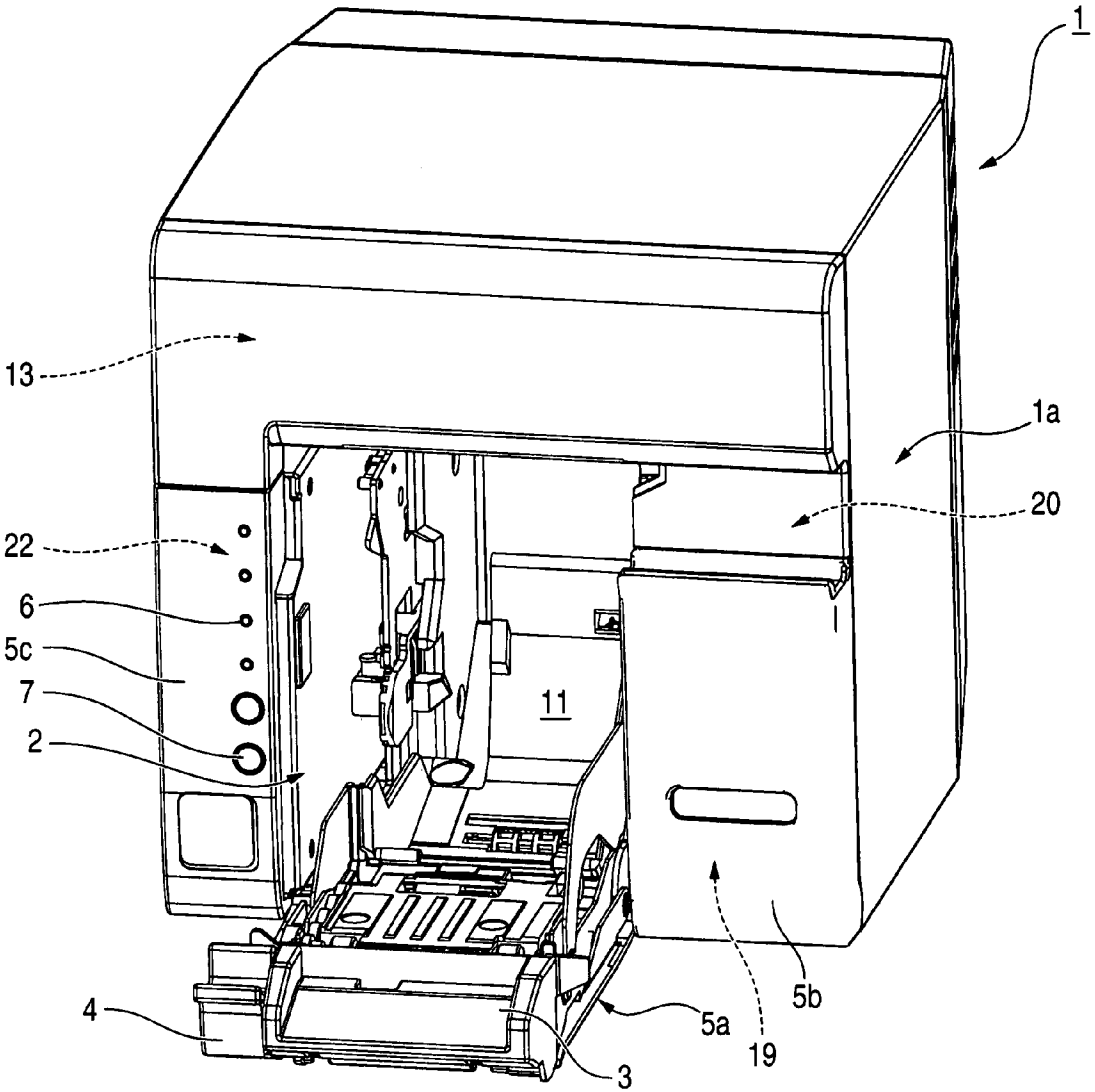
FIG. 2 is a perspective view of the printer with the front door cover opened.

As shown in FIGS. 1 and 2, a rolled sheet printer 1 according to one embodiment of the invention comprises an outer casing 1*a* in a substantially cuboid shape as a whole, and a sheet outlet 2 is formed on a front face of the outer casing 1*a*. An ejected sheet guide 3 is projected forward below the sheet outlet 2, and a cover opening lever 4 is provided at a side of the ejected sheet guide 3.

A rectangular opening 1*b* is formed in the outer casing 1*a* below the ejected sheet guide 3 and the cover opening lever 4. The opening 1*b* is closed with a cover 5*a* which can be opened forward. When the cover opening lever 4 is operated to unlock a cover locking mechanism, which is not shown, and the ejected sheet guide 3 is pulled forward, the cover 5*a* is tilted around a lower end portion thereof to be opened forward until it takes a substantially horizontal position, as shown in FIG. 2. When the cover 5*a* is opened, a rolled sheet chamber 11 which is formed inside the printer is exposed, and it is possible to exchange the rolled sheet or to do other operations from a front side of the printer.

Another opening 1*c* is formed at a right side of the cover 5*a*, and a cover 5*b* which can be opened by tilting it around a lower end thereof is attached to the opening 1*c*. When this cover 5*b* is opened, an ink cartridge chamber 19 which is an ink supply part is made free, and it is possible to replace an ink cartridge from the front side of the printer. A control panel 5*c* is provided at a left side of the cover 5*a*, and status indicators 6 including LEDs, a sheet feeding button 7, etc. are arranged on the control panel 5*c*.

Figure 3:
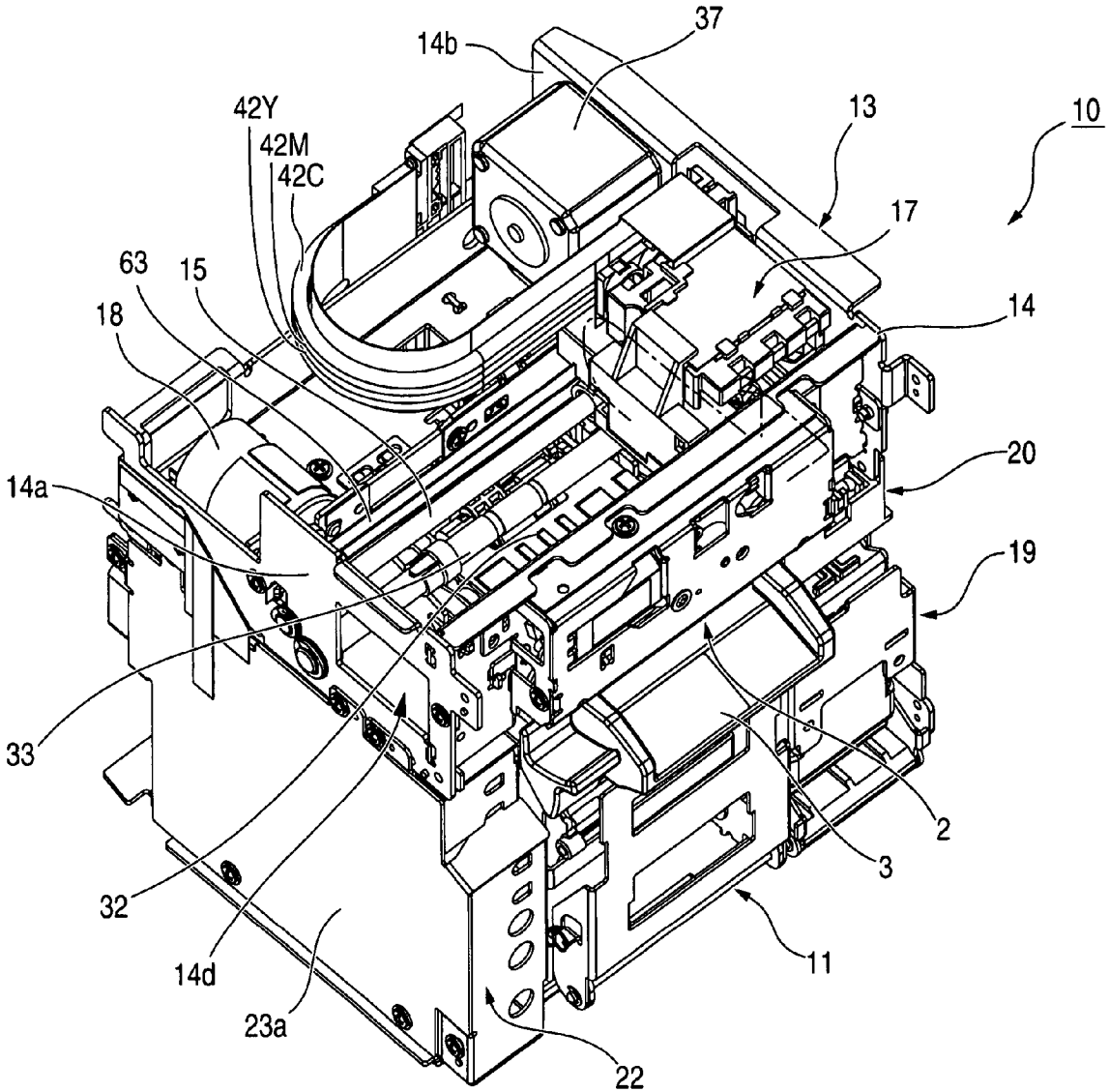
FIG. 3 is a perspective view showing an internal mechanism of the printer.
Figure 4:
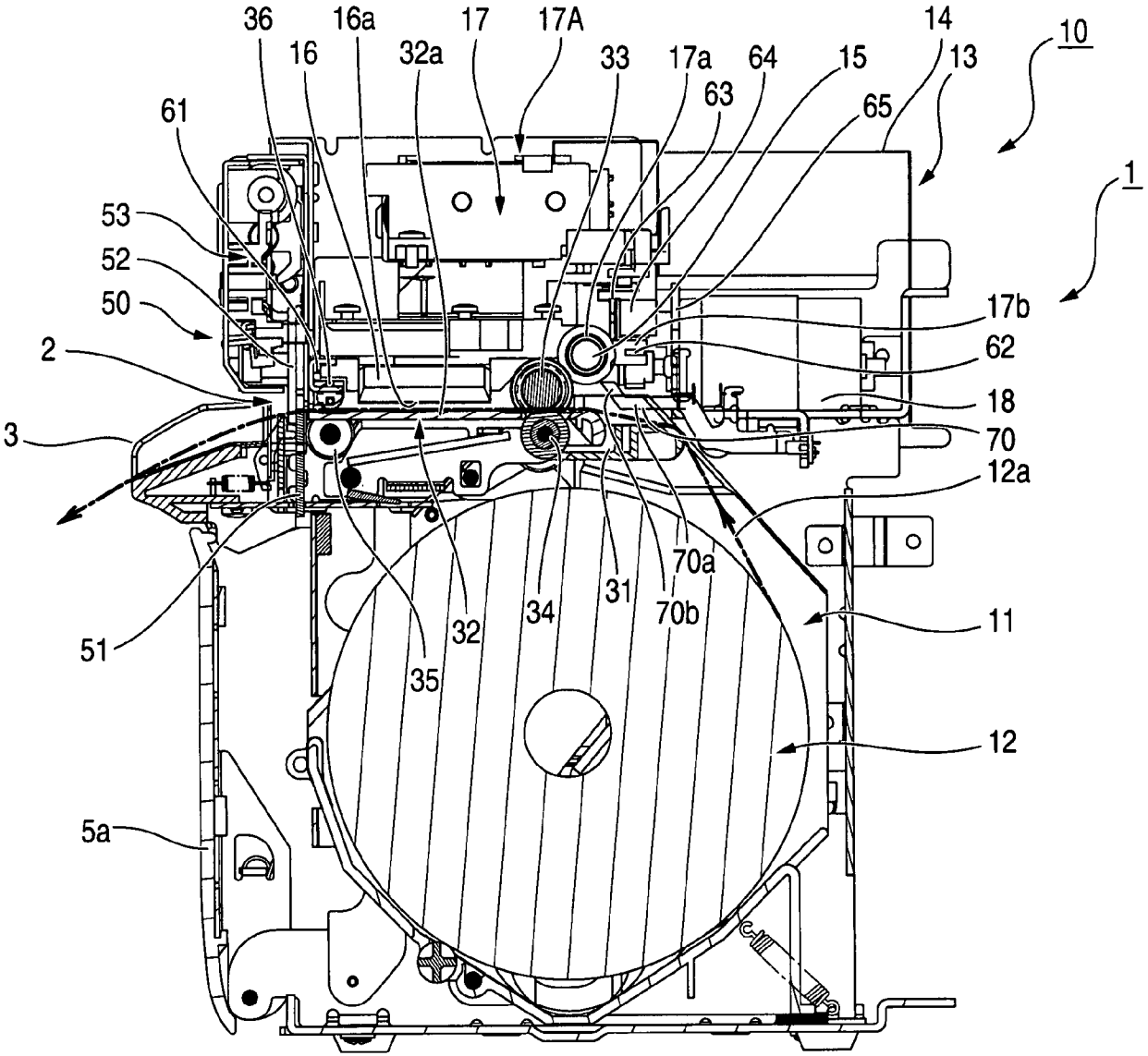
FIG. 4 is a section view of the printer along a front-rear direction.
Figure 5:
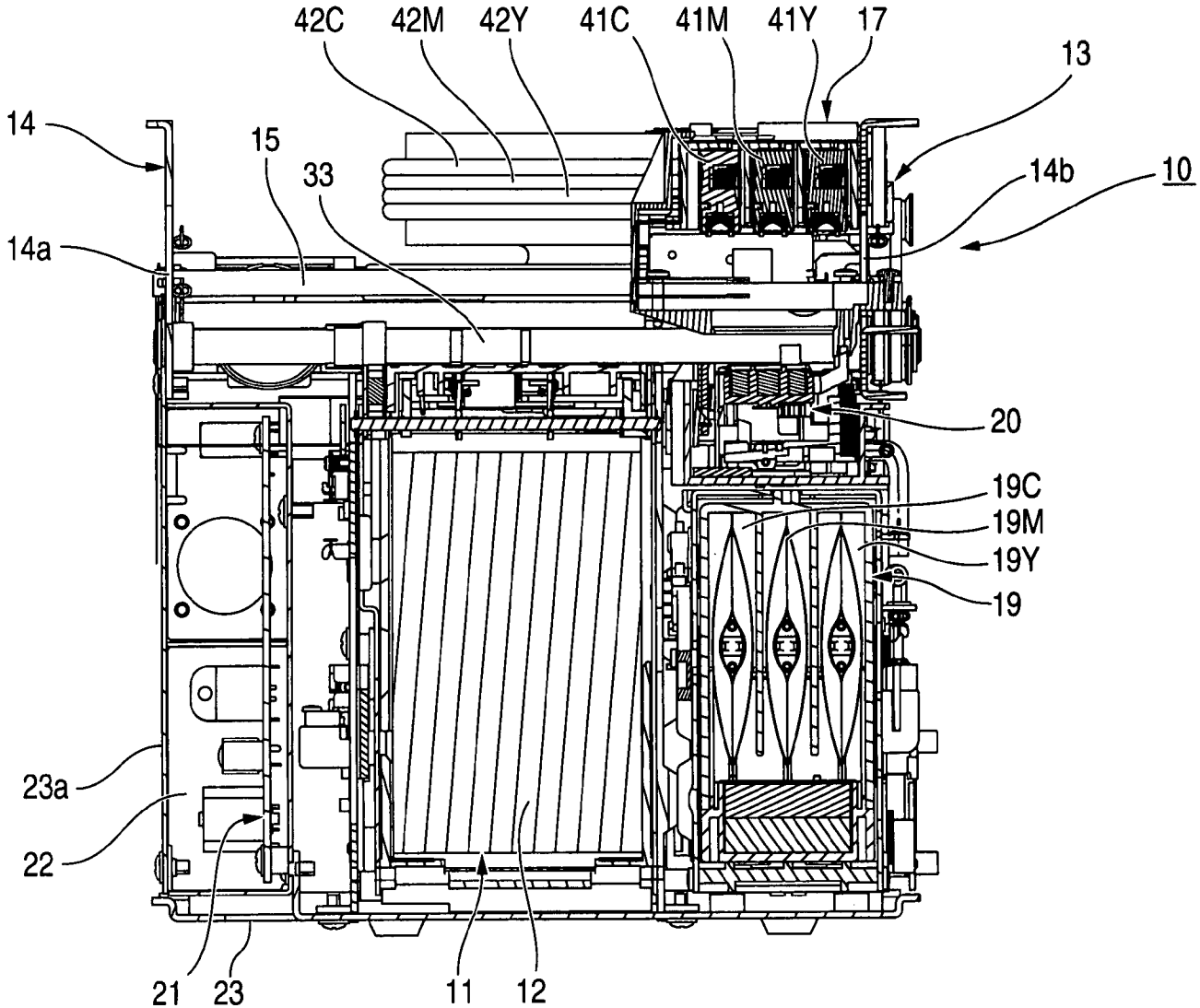
FIG. 5 is a section view of the printer along a right-left direction.

As shown in FIGS. 3 to 5, the rolled sheet chamber 11 is arranged in a center part in the lateral direction (right-left direction) of a printer mechanism part 10, and a rolled sheet 12 is accommodated in this rolled sheet chamber 11 in a horizontally mounted state directed to the lateral direction of the printer. A head unit 13 is horizontally mounted above the rolled sheet chamber 11. The head unit 13 includes a head unit frame 14 which is described later in detail, and a carriage guide shaft 15 which is horizontally bridged between right and left side frames 14*a* and 14*b* of the head unit frame 14. A carriage 17 on which an ink jet head 16 is mounted in a downwardly directed manner is adapted to move reciprocally along the carriage guide shaft 15 by a carriage motor 18.

The head unit 13 is wider than the rolled sheet chamber 11 such that a moving path of the carriage 17 includes a printing area in a direction of a printing width with respect to an elongated sheet 12*a* which is drawn out from the rolled sheet 12 in the rolled sheet chamber 11. A width dimension of the printer is defined by the head unit 13.

As shown in FIG. 5, the ink cartridge chamber 19 and a head maintenance unit 20 are disposed in a space which is enclosed by the rolled sheet chamber 11, a right side portion of the head unit 13 projecting to the right above the rolled sheet chamber 11, and a right side frame of the outer casing 1*a*. Three ink cartridges 19C, 19M and 19Y each having a flat rectangular parallelepiped shape can be loaded from the front face of the ink cartridge chamber in a vertical orientation into the ink cartridge chamber 19 which is arranged in a lower part. The ink cartridges 19C, 19M and 19Y are filled with inks respectively of cyan, magenta and yellow, for example. The head maintenance unit 20, which is disposed above the ink cartridge chamber 19, includes a wiper for wiping off a nozzle face of the ink jet head 16, and a recovery section (not shown) for recovering waste ink which is ejected or ejected from nozzles of the nozzle face, in the same manner as a known head maintenance unit.

A space enclosed by the rolled sheet chamber 11, a left side portion of the head unit 13, and a left side frame of the outer casing 1*a* is defined as a board mounting section 22 to which a control board 21 is mounted. This board mounting section 22 is covered with a left side frame 23*a* of a printer body frame 23 which is positioned inside the right side frame of the outer casing 1*a*. The control board 21 is disposed in a vertical posture (in a vertically mounted state) inside the board mounting section 22. The respective status indicators 6, the sheet feeding button 7, etc. arranged on the control panel 5*c* are connected to corresponding circuit parts on the control board 21.

As shown in FIG. 4, a sheet guide 31 is provided at a rear side position between the rolled sheet chamber 11 and the head unit 13, horizontally along the lateral direction of the printer. A platen 32 is provided at a higher position by one step, in front of the sheet guide 31, horizontally in a longitudinal direction of the printer. The ink jet head 16 which is mounted on the carriage 17 is arranged directly above the platen 32. The nozzle face 16*a* of the ink jet head 16 is opposed to an upper face 32*a* of the platen 32 keeping a certain gap, and a printing position is defined by the upper face 32*a*.

A first sheet transporting roller 33 is suspended at a position behind the platen 32, horizontally in the lateral direction of the printer. The first sheet transporting roller 33 is pressed with a determined pressure from below by a first press roller 34 having a determined width. The first sheet transporting roller 33 is driven by a sheet feeding motor 37 which is mounted on the head unit 13. A second sheet transporting roller 35 is arranged at a front end of the platen 32. The second sheet transporting roller 35 is pressed from above by a second press roller 36.

The carriage 17 is provided with ink dampers 41C, 41M and 41Y to which three flexible ink tubes 42C, 42M and 42Y are connected at their one ends. The other ends of the ink tubes 42C, 42M and 42Y are respectively connected to the ink cartridges 19C, 19M and 19Y which are mounted in the ink cartridge chamber 19. The respective ink colors are supplied to the ink jet head 16 through the ink tubes 42C, 42M and 42Y, thus enabling the ink jet head 16 to conduct full color printing.

As shown by a thick chain line in FIG. 4, the sheet 12*a* drawn out from the rolled sheet 12 which is accommodated in the rolled sheet chamber 11 is guided by the sheet guide 31 to pass between the first sheet transporting roller 33 and the first press roller 34, and moves along an upper face 32*a* of the platen 32 to pass between the second sheet transporting roller 35 and the second press roller 36, and then ejected from the sheet outlet 2.

When the first sheet transporting roller 33 and the second sheet transporting roller 35 are rotated in this state, the sheet 12*a* is conveyed. The ink jet head 16 is driven while moving the carriage 17 in the lateral direction of the printer in synchronization with conveyance of the sheet 12*a*, and printing is performed on the surface of the sheet 12*a* passing the printing position (32*a*).

A scissor type cutter 50 is disposed at the sheet outlet 2. The cutter 50 includes a fixed cutter 51 vertically arranged in an upwardly directed manner, and a movable cutter 52 vertically arranged in a downwardly directed manner. When the movable cutter 52 is tilted in a vertical direction around its one end in the lateral direction of the printer by a cutter driving mechanism 53, a point of contact with the fixed cutter 51 moves in the lateral direction of the printer, so that the sheet 12*a* positioned between them can be cut in the lateral direction. After a series of printings on the sheet 12*a* is completed, the conveyance of the sheet 12*a* is stopped where a printed portion of the sheet 12*a* is ejected from the sheet outlet 2 by a determined length, for example. By cutting the sheet 12*a* with the cutter 50, it is possible to eject a sheet having the determined length on which the printing is performed.

In this embodiment, the rolled sheet chamber 11 is disposed at the center in the lateral direction of the printer, and the head unit 13 having the largest width is horizontally disposed above the rolled sheet chamber 11. Those spaces which are formed at the right and left sides of the rolled sheet chamber 11 below the head unit 13 are utilized as the spaces for arranging the ink cartridge chamber 19, the head maintenance unit 20 and the board mounting section 22. In this manner, no dead space is left at both sides of the rolled sheet chamber 11, which is advantageous in downsizing the rolled sheet printer 1.

Particularly, it is advantageous in the following respects, as compared to a case where the control board 21 is arranged horizontally in the bottom part of the printer. First, a dimension of the printer in height can be reduced. Second, when liquid such as leaked ink or water falls on the rolled sheet printer 1, the liquid may stand on the control board surface which is horizontally arranged, and may cause a short circuit or other problem. In the case where the control board 21 is vertically arranged, however, the liquid rapidly falls down along the board surface, and a short circuit or other problem will not happen.

Moreover, the openings 1*b* and 1*c* for the rolled sheet chamber 11 and the ink cartridge chamber 19 are formed on the front face of the printer to facilitate replacing the rolled sheet 12 and the ink cartridges 19Y, 19M and 19C from the front side of the printer 1. Alternatively, at least one of the openings 1*b* for the rolled sheet chamber 11 and the opening 1*c* for the ink cartridge chamber 19 may be provided on the upper face of the printer. It is of course possible to provide the openings for the rolled sheet chamber 11 and the ink cartridge chamber 19 on the side face of the printer. In this case, the rolled sheet 12 is accommodated in the rolled sheet chamber 11 in a horizontally mounted state in the front-rear direction of the printer, and the ink jet head 16 is so constructed as to reciprocally move in the front-rear direction of the printer.

Figure 6C:
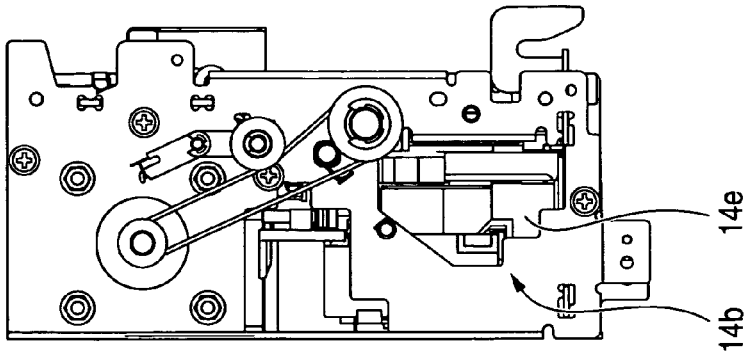
FIG. 6C is a right side view of the head unit.
Figure 6A:
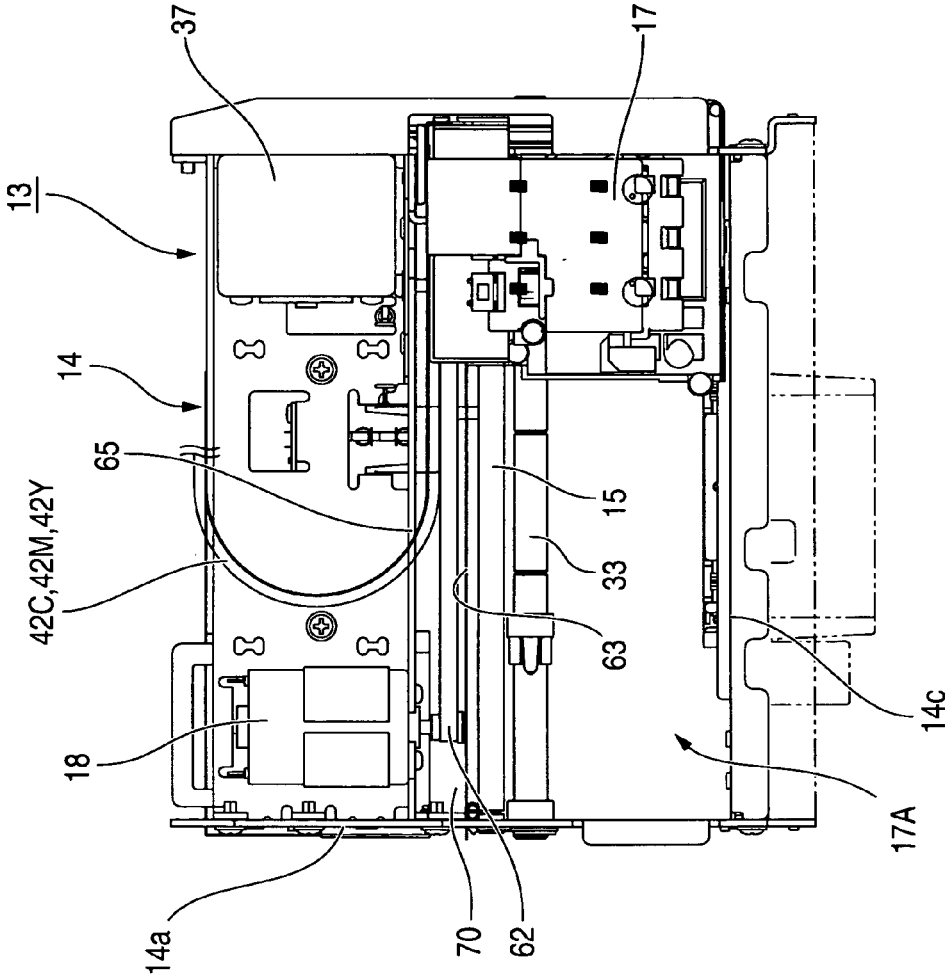
FIG. 6A is a top plan view of a head unit in the printer.
Figure 6B:
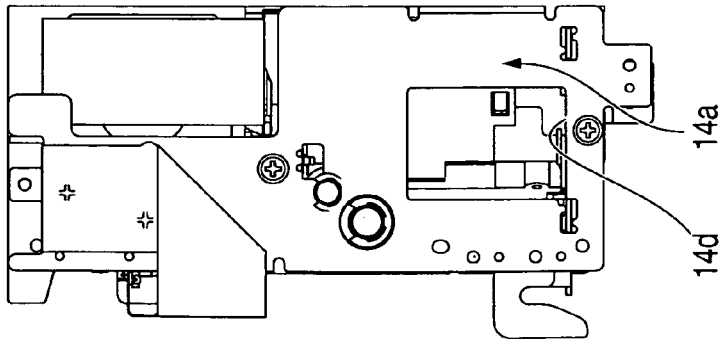
FIG. 6B is a left side view of the head unit.

As shown in FIGS. 6A to 6C, the head unit 13 includes the head unit frame 14 as described above. The carriage guide shaft 15 is bridged between the right and left side frames 14*a* and 14*b* of the head unit frame 14, horizontally in the lateral direction of the printer. A guide shaft hole 17*a* for passing the carriage guide shaft 15 therethrough is formed in a lower part of a back face of the carriage 17 on which the ink jet head 16 is mounted. A lower end portion of a front face of the carriage 17 rests on a guide rail 61 which extends horizontally in the lateral direction of the printer, so that the carriage 17 can move reciprocally in the lateral direction of the printer while keeping a certain posture.

A mechanism for reciprocally moving the carriage 17 along the carriage guide shaft 15 includes a carriage motor 18, and a timing belt 62 which is driven by the carriage motor 18. The timing belt 62 is stretched horizontally in the lateral direction of the printer at a position behind and near the carriage guide shaft 15, and fixed to a belt connection part 17*b* which is projected backward from the guide shaft hole 17*a*.

Moreover, a DC motor is employed as the carriage motor 18, and a linear scale 63 is provided for servo controlling the DC motor 18. The linear scale 63 is arranged above and near a position between and in parallel to the carriage guide shaft 15 and the timing belt 62, which extend horizontally in the lateral direction. The linear scale 63 is provided with a slit pattern (not shown) for example, on its surface opposing the rear side of the printer. A photo sensor 64 is mounted on the carriage guide 17 at a position above the guide shaft hole 17*a*. When the carriage 17 is moved, the photo sensor 64 moves along the surface of the linear scale 63 thereby to detect the slit pattern.

Further, as shown in FIG. 4, a vertical partition plate 65 is attached to the head unit frame 14 behind the timing belt 62. The vertical partition plate 65 is bridged between the right and left side frames 14*a* and 14*b* in the lateral direction of the printer. An air flow regulating plate 70 is attached to a front face of this vertical partition plate 65 at a position between the timing belt 62 and the sheet guide 31. The air flow regulating plate 70 has, in a sectional shape, a horizontal frame 70*a* extending forward from the vertical partition plate 65, and an inclined frame 70*b* inclined upward from a front end of the horizontal frame 70*a*. The air flow regulating plate 70 extends over an entire width between the right and left side frames 14*a* and 14*b*. In other words, the air flow regulating plate 70 is arranged across a moving range of the carriage 17. The horizontal frame 70*a* of the air flow regulating plate 70 is positioned at substantially the same height as the nozzle face 16*a* of the ink jet head 16 which is mounted on the carriage 17. The linear scale 63 is substantially isolated from the nozzle face 16*a* of the ink jet head 16 by this air flow regulating plate 70, at a position behind the carriage 17.

The moving path of the carriage 17, that is, the moving path of the ink jet head 16 lies in the lateral direction of the printer which is defined by the carriage guide shaft 15. As shown in FIGS. 3 and 6A, a moving space 17A of the carriage 17 is enclosed by the right and left side frames 14*a*, 14*b*, the front frame 14*c* of the head unit frame 14, and the vertical partition plate 65. Moreover, a space below the moving space 17A is blocked by the platen 32 and the sheet guide 31.

In this embodiment, the right and left side frames 14*a*, 14*b* are formed with openings 14*d* and 14*e* at positions corresponding to the right and left side faces of the carriage 17, as shown in FIGS. 6B and 6C. Specifically, the openings 14*d* and 14*e* are formed at positions opposed to side parts of the nozzle face 16*a* of the ink jet head 16 which is mounted on the carriage 17.

In the head unit 13 having the air flow regulating plate 70 and the right and left openings 14*d*, 14*e* as described above, an amount of ink mist generated can be reduced. Moreover, it is possible to prevent the generated ink mist from adhering to the surface of the linear scale 63.

Specifically, when an ink drop is ejected from the ink jet head 16 mounted on the carriage 17 toward the sheet 12*a* while the carriage 17 is moved, a part of the ejected ink is formed into ink mist and scattered. Additionally, because the nozzle face 16*a* of the ink jet head 16 moves in a narrow gap facing the sheet 12*a* on the platen 32, a negative pressure is created between the nozzle face 16*a* and the sheet 12*a* due to the movement of the ink jet head 16. Consequently, a part of the ink drop which is ejected to the sheet 12*a* may be blown off and scattered.

In this embodiment, the head unit 13 is provided with the openings 14*d* and 14*e* for passage of air in the right and left side frames 14*a* and 14*b*, which enclose both sides of the moving space 17A of the carriage 17. These openings 14*d* and 14*e* are formed at the positions corresponding to the nozzle face 16*a* of the ink jet head 16. Therefore, when the carriage 17 is moved to the right and left, the air is smoothly introduced into the carriage moving space 17A through the openings 14*d* and 14*e*. Accordingly, an air stream created with the movement of the carriage 17 in the carriage moving space 17A is smoothed, and the occurrence of a turbulent flow is restrained. Moreover, the negative pressure created between the nozzle face 16*a* of the ink jet head 16 and the sheet 12*a* due to the movement of the carriage 17 is moderated. As a result, an amount of the ink mist to be generated can be reduced.

Further, since the linear scale 63 is substantially isolated from the nozzle face 16*a* of the ink jet head 16 by the air flow regulating plate 70 across the moving path of the carriage, the ink mist generated between the nozzle face 16*a* and the sheet 12*a* is blocked by the air flow regulating plate 70 so as not to be scattered toward the linear scale 63 from the back side of the carriage 17. In this manner, the surface of the linear scale 63 is prevented from being soiled with the ink mist.

As described above, in this embodiment, it is possible to reduce generation of the ink mist. Moreover, because the ink mist can be prevented from being scattered toward the linear scale, it is possible to reliably prevent or restrain the linear scale 63 from being soiled with the ink mist.

Further, the air flow regulating plate 70 is arranged in a vacant space which is formed between the timing belt 62 and the sheet guide 31 and extends in the lateral direction of the printer (the direction along the moving path of the carriage). Consequently, the air flow regulating plate 70 can be provided without increasing the dimension of the printer, and hence, will not hinder the printer from being downsized.

Although in the above described embodiment, the invention is applied to the rolled sheet printer of the ink jet type, the invention is not limited to the ink jet printer. It is apparent that the invention can be also applied to a serial type printer provided with a printing head of some other type.

The disclosure of Japanese Patent Applications No. 2005-353040 filed Dec. 7, 2005 and No. 2005-353041 filed Dec. 7, 2005 including specifications, drawings and claims are incorporated herein by reference in their entirety.

What is claimed is:

1. A printer, comprising:

a first section sized to accommodate a rolled sheet therein;

a printing head horizontally movable along a moving path extending in a first direction and operable to perform printing on a part of the rolled sheet which is drawn out from the first section;

a second section on a first side of the first section relative to the first direction;

a third section on a second side of the first section relative to the first direction opposite to the first side;

a control board on which a circuit operable to control an operation of the printer is mounted disposed in the second section so as to extend vertically; and an ink supplying member disposed in the third section that supplies ink to the printing head, wherein the moving path is longer than a dimension of the first section in the first direction.

2. The printer as set forth in claim 1, wherein the printing head is an ink jet head.

3. The printer as set forth in claim 2, further comprising a head maintenance unit that performs a maintenance operation for the printing head, the head maintenance unit disposed on the moving path on the second side of the first section.

4. The printer as set forth in claim 3, wherein the head maintenance unit is disposed above the third section.

5. The printer as set forth in claim 4, further comprising a head unit disposed above the first section, the control board and the head maintenance unit, the head unit comprising:

a unit frame including a main frame extending in the first direction and side frames provided on both ends of the main frame relative to the first direction;

a guide shaft extending in the first direction and bridging the side frames; and a carriage mounting the printing head and being movable along the guide shaft to carry the printing head along the moving path.

6. The printer as set forth in claim 5, wherein the first section is arranged such that an axial direction of the rolled sheet matches with the first direction.

7. The printer as set forth in claim 6, wherein:

the first section is formed with an opening arranged such that the rolled sheet is replaced therethrough; and the opening is located in a front side of the printer.

8. The printer as set forth in claim 7, wherein the ink supplying member is an ink cartridge.

9. The printer as set forth in claim 8, wherein the third section is formed with an opening arranged such that the ink cartridge is replaced therethrough.

10. The printer as set forth in claim 2, further comprising:

a linear scale extending in the first direction and provided with slit patterns adapted to be detected to determine a position of the printing head in the first direction; and a plate member extending in the first direction and disposed between the moving path and the linear scale, the plate member being sized and positioned to block an air stream flowing from the printing head to the linear scale.

11. The printer as set forth in claim 10, further comprising:

a first plate member disposed adjacent a first end of the moving path; and a second plate member disposed adjacent a second end of the moving path opposite to the first end, wherein at least one of the first plate member and the second plate member is formed with a through hole.

12. The printer as set forth in claim 11, further comprising:

a guide shaft extending in the first direction and bridging the first plate member and the second plate member; and a carriage mounting the printing head and being movable along the guide shaft to carry the printing head along the moving path, wherein the through hole opposes the carriage.

13. The printer as set forth in claim 12, further comprising:

a head unit disposed above the first section, the control board and the head maintenance unit, wherein the printing head, the carriage, the guide shaft, the linear scale and the plate member are integrated in the head unit.

* * * * *